US009328697B2

(12) United States Patent
Peters et al.

(10) Patent No.: US 9,328,697 B2
(45) Date of Patent: May 3, 2016

(54) METHODS AND SYSTEM FOR CONTROLLING EXHAUST BACKFLOW

(71) Applicant: General Electric Company, Schenectady, NY (US)

(72) Inventors: Eric David Peters, Erie, PA (US); Nicholas Eric Hansen, Erie, PA (US); Rose Denning, Erie, PA (US)

(73) Assignee: General Electric Company, Schenectady, NY (US)

( * ) Notice: Subject to any disclaimer, the term of this patent is extended or adjusted under 35 U.S.C. 154(b) by 327 days.

(21) Appl. No.: 13/969,648

(22) Filed: Aug. 19, 2013

(65) Prior Publication Data

US 2015/0047322 A1 Feb. 19, 2015

(51) Int. Cl.
*F02M 25/07* (2006.01)
*F02D 41/00* (2006.01)

(52) U.S. Cl.
CPC ..... *F02M 25/074* (2013.01); *F02D 41/0077* (2013.01); *F02D 41/0082* (2013.01); *F02M 25/07* (2013.01); *F02M 25/0715* (2013.01)

(58) Field of Classification Search
CPC ..... F02M 25/07; F02M 25/0715; F02D 41/0077; F02D 41/0082
USPC ..... 123/568.12, 568.16, 568.17, 568.18, 123/568.2, 568.21, 568.22; 701/108
See application file for complete search history.

(56) References Cited

U.S. PATENT DOCUMENTS 5,517,976 A * 5/1996 Bachle ..... F01N 3/021 123/568.11
6,904,898 B1 * 6/2005 Sahlen ..... F02M 25/0701 123/568.12
7,805,926 B2 * 10/2010 Abi-Akar ..... F02M 25/0709 123/568.11
2004/0050373 A1 * 3/2004 Gao ..... F02M 25/074 123/568.12
2004/0074480 A1 * 4/2004 Chen ..... F02M 25/0732 123/568.12
2006/0137660 A1 * 6/2006 Shirakawa ..... F02D 41/0005 123/493
2010/0263360 A1 * 10/2010 Le Flem ..... F02M 25/0707 60/309
2011/0023847 A1 * 2/2011 Gates ..... F02D 41/0072 123/568.21
2012/0000448 A1 * 1/2012 Freund ..... F02M 25/0749 123/568.21
2012/0090584 A1 * 4/2012 Jung ..... F02D 41/0065 123/568.12
2015/0083095 A1 * 3/2015 Hanamura ..... F02M 25/07 123/568.2

OTHER PUBLICATIONS

Method and Systems for Particle Separation in an Exhaust Gas Recirculation System; filed Jun. 6, 2013; Eric Peters, et al; U.S. Appl. No. 13/911,304.

* cited by examiner

*Primary Examiner* — Mahmoud Gimie
(74) *Attorney, Agent, or Firm* — GE Global Patent Operation; John A. Kramer

(57) ABSTRACT

Various methods and systems are provided for blocking backflow of exhaust through an exhaust gas recirculation system. In one embodiment, a method comprises flowing exhaust gas through an exhaust gas recirculation (EGR) passage in a first direction from at least a first cylinder group of an engine to an intake manifold of the engine, the exhaust gas flowing in the first direction through a filter arranged in the EGR passage prior to reaching the intake manifold, and blocking flow of gas through the filter in a second, opposite direction with a mechanical one-way valve positioned in the EGR passage between the filter and the intake manifold.

19 Claims, 3 Drawing Sheets

METHODS AND SYSTEM FOR CONTROLLING EXHAUST BACKFLOW

FIELD

Embodiments of the subject matter disclosed herein relate to an engine, engine components, and an engine system, for example.

BACKGROUND

Engine components may degrade over time, resulting in internally generated wear debris, e.g., small particles. Wear debris particles may pass through an exhaust system of the engine and exit the engine through a muffler or exhaust stack. Engines may utilize recirculation of exhaust gas from the engine exhaust system to an intake system, a process referred to as exhaust gas recirculation (EGR), to reduce regulated emissions. If the engine uses EGR, a portion of the exhaust carrying wear debris may be cooled and mixed with the charge air in the intake system to be used in the combustion process. When recirculated, internally generated particles may pass through the rest of the engine system, thereby leading to further degradation of engine components.

To prevent accumulation of debris in the engine, a filter may be provided in the EGR system. The filter may trap debris and various particles, preventing the recirculation of the debris to the engine. However, under certain conditions the pressure differential in the engine may reverse, causing the exhaust to backflow through the EGR system to the engine. Such exhaust backflow may dislodge the debris trapped in the filter and transport the debris to the engine.

BRIEF DESCRIPTION

In one embodiment, a method comprises flowing exhaust gas through an exhaust gas recirculation (EGR) passage in a first direction from at least a first cylinder group of an engine to an intake manifold of the engine, the exhaust gas flowing in the first direction through a filter arranged in the EGR passage prior to reaching the intake manifold, and blocking flow of gas through the filter in a second, opposite direction with a mechanical one-way valve positioned in the EGR passage between the filter and the intake manifold.

In this way, flow of exhaust gas is allowed through the filter when the exhaust gas travels through the EGR system in a first direction towards the intake manifold, but is blocked from flowing through the filter in a second, opposite direction back towards the cylinders. The gas flowing in the second direction (which may include both exhaust and intake air) may be blocked by the one-way mechanical valve, such as a check valve. The check valve may block exhaust flow in the second direction but allow exhaust flow in the first direction. By blocking flow through the filter in the second direction, dislodging of debris accumulated in the filter is prevented.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The present invention will be better understood from reading the following description of non-limiting embodiments, with reference to the attached drawings, wherein below.

DETAILED DESCRIPTION

The following description relates to various embodiments of preventing backflow of exhaust and/or intake air through a filter positioned in an exhaust gas recirculation (EGR) system. Exhaust backflow may occur when the pressure differential between the exhaust pressure and intake pressure reverses. For example, during some engine shutdown conditions, the exhaust pressure may drop below the intake pressure, causing exhaust to flow back to the engine. To prevent this backflow from traveling through the filter and to the engine, a one-way mechanical valve (e.g., check valve) may be positioned in an EGR passage downstream from the filter in an EGR flow direction (e.g., between the filter and a junction between the EGR passage and intake passage). In another example, the backflow may be blocked from the filter by closing one or more EGR valves responsive to an indication the exhaust is flowing or is about to flow back to the engine. For example, during a rapid engine shutdown where exhaust backflow through the EGR system is likely to occur, the one or more EGR valves may be closed.

The approach described herein may be employed in a variety of engine types, and a variety of engine-driven systems. Some of these systems may be stationary, while others may be on semi-mobile or mobile platforms. Semi-mobile platforms may be relocated between operational periods, such as mounted on flatbed trailers. Mobile platforms include self-propelled vehicles. Such vehicles can include mining equipment, marine vessels, on-road transportation vehicles, off-highway vehicles (OHV), and rail vehicles. For clarity of illustration, a locomotive is provided as an example of a mobile platform supporting a system incorporating an embodiment of the invention.

Figure 1:
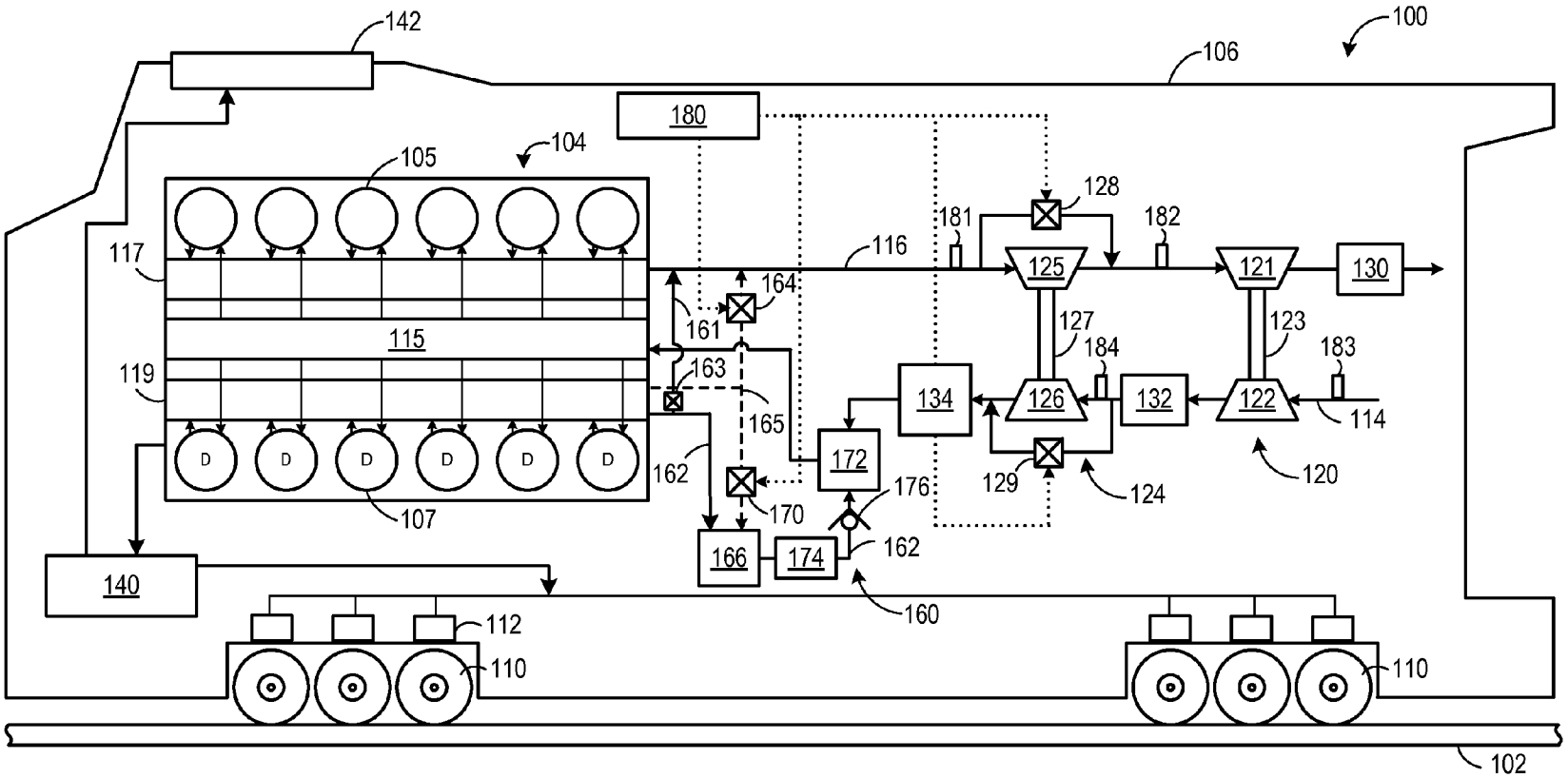
FIG. 1 shows a schematic diagram of a rail vehicle with an engine according to an embodiment of the invention.

Before further discussion of the approach for blocking EGR backflow through an EGR filter, an example of a platform is disclosed in which the engine system may be installed in a vehicle, such as a rail vehicle. For example, FIG. 1 shows a block diagram of an embodiment of a vehicle system 100 (e.g., a locomotive system), herein depicted as a rail vehicle 106, configured to run on a rail 102 via a plurality of wheels 110. As depicted, the rail vehicle 106 includes an engine 104. In other non-limiting embodiments, the engine 104 may be a stationary engine, such as in a power-plant application, or an engine in a marine vessel or off-highway vehicle propulsion system as noted above.

The engine 104 receives intake air for combustion from an intake, such as an intake manifold 115. The intake may be any suitable conduit or conduits through which gases flow to enter the engine. For example, the intake may include the intake manifold 115, the intake passage 114, and the like. The intake passage 114 receives ambient air from an air filter (not shown) that filters air from outside of a vehicle in which the engine 104 may be positioned. Exhaust gas resulting from combustion in the engine 104 is supplied to an exhaust, such as exhaust passage 116. The exhaust may be any suitable conduit through which gases flow from the engine. For example, the exhaust may include an exhaust manifold 117, the exhaust passage 116, and the like. Exhaust gas flows through the exhaust passage 116, and out of an exhaust stack of the rail vehicle 106. In one example, the engine 104 is a diesel engine that combusts air and diesel fuel through compression ignition. In other non-limiting embodiments, the engine 104 may combust fuel including gasoline, kerosene, biodiesel, or other petroleum distillates of similar density through compression ignition (and/or spark ignition).

In one embodiment, the rail vehicle 106 is a diesel-electric vehicle. As depicted in FIG. 1, the engine 104 is coupled to an electric power generation system, which includes an alternator/generator 140 and electric traction motors 112. For example, the engine 104 is a diesel engine that generates a torque output that is transmitted to the alternator/generator 140 which is mechanically coupled to the engine 104. The alternator/generator 140 produces electrical power that may be stored and applied for subsequent propagation to a variety of downstream electrical components. As an example, the alternator/generator 140 may be electrically coupled to a plurality of traction motors 112 and the generator 140 may provide electrical power to the plurality of traction motors 112. As depicted, the plurality of traction motors 112 are each connected to one of a plurality of wheels 110 to provide tractive power to propel the rail vehicle 106. One example configuration includes one traction motor per wheel. As depicted herein, six pairs of traction motors correspond to each of six pairs of wheels of the rail vehicle. In another example, alternator/generator 140 may be coupled to one or more resistive grids 142. The resistive grids 142 may be configured to dissipate excess engine torque via heat produced by the grids from electricity generated by alternator/generator 140.

In the embodiment depicted in FIG. 1, the engine 104 is a V-12 engine having twelve cylinders. In other examples, the engine may be a V-6, V-8, V-10, V-16, I-4, I-6, I-8, opposed 4, or another engine type. As depicted, the engine 104 includes a subset of non-donor cylinders 105, which includes six cylinders that supply exhaust gas exclusively to a non-donor cylinder exhaust manifold 117, and a subset of donor cylinders 107, which includes six cylinders that supply exhaust gas exclusively to a donor cylinder exhaust manifold 119. In other embodiments, the engine may include at least one donor cylinder and at least one non-donor cylinder. For example, the engine may have four donor cylinders and eight non-donor cylinders, or three donor cylinders and nine non-donor cylinders. It should be understood, the engine may have any desired numbers of donor cylinders and non-donor cylinders, with the number of donor cylinders typically lower than the number of non-donor cylinders.

As depicted in FIG. 1, the non-donor cylinders 105 are coupled to the exhaust passage 116 to route exhaust gas from the engine to atmosphere (after it passes through an exhaust gas treatment system 130 and first and second turbochargers 120 and 124). The donor cylinders 107, which provide engine exhaust gas recirculation (EGR), are coupled exclusively to an EGR passage 162 of an EGR system 160 which routes exhaust gas from the donor cylinders 107 to the intake passage 114 of the engine 104, and not to atmosphere. By introducing cooled exhaust gas to the engine 104, the amount of available oxygen for combustion is decreased, thereby reducing combustion flame temperatures and reducing the formation of nitrogen oxides (e.g., $NO_x$).

Exhaust gas flowing from the donor cylinders 107 to the intake passage 114 passes through a heat exchanger such as an EGR cooler 166 to reduce a temperature of (e.g., cool) the exhaust gas before the exhaust gas returns to the intake passage. The EGR cooler 166 may be an air-to-liquid heat exchanger, for example. In such an example, one or more charge air coolers 132 and 134 disposed in the intake passage 114 (e.g., upstream of where the recirculated exhaust gas enters) may be adjusted to further increase cooling of the charge air such that a mixture temperature of charge air and exhaust gas is maintained at a desired temperature. In other examples, the EGR system 160 may include an EGR cooler bypass. Alternatively, the EGR system may include an EGR cooler control element. The EGR cooler control element may be actuated such that the flow of exhaust gas through the EGR cooler is reduced; however, in such a configuration, exhaust gas that does not flow through the EGR cooler is directed to the exhaust passage 116 rather than the intake passage 114.

Additionally, in some embodiments, the EGR system 160 may include an EGR bypass passage 161 that is configured to divert exhaust from the donor cylinders back to the exhaust passage. The EGR bypass passage 161 may be controlled via a valve 163. The valve 163 may be configured with a plurality of restriction points such that a variable amount of exhaust is routed to the exhaust, in order to provide a variable amount of EGR to the intake.

In an alternate embodiment shown in FIG. 1, the donor cylinders 107 may be coupled to an alternate EGR passage 165 (illustrated by the dashed lines) that is configured to selectively route exhaust to the intake or to the exhaust passage. For example, when a second valve 170 is open, exhaust may be routed from the donor cylinders to the EGR cooler 166 via alternate EGR passage 165 and then routed to the intake passage 114 via EGR passage 162.

Further, the alternate EGR system includes a first valve 164 disposed between the exhaust passage 116 and the alternate EGR passage 165. The second valve 170 may be an on/off valve controlled by the control unit 180 (for turning the flow of EGR on or off), or it may control a variable amount of EGR, for example. In some examples, the first valve 164 may be actuated such that an EGR amount is reduced (exhaust gas flows from the EGR passage 165 to the exhaust passage 116). In other examples, the first valve 164 may be actuated such that the EGR amount is increased (e.g., exhaust gas flows from the exhaust passage 116 to the EGR passage 165). In some embodiments, the alternate EGR system may include a plurality of EGR valves or other flow control elements to control the amount of EGR.

In such a configuration, the first valve 164 is operable to route exhaust from the donor cylinders to the exhaust passage 116 of the engine 104 and the second valve 170 is operable to route exhaust from the donor cylinders to the intake passage 114 of the engine 104. As such, the first valve 164 may be referred to as an EGR bypass valve, while the second valve 170 may be referred to as an EGR metering valve. In the embodiment shown in FIG. 1, the first valve 164 and the second valve 170 may be engine oil, or hydraulically, actuated valves, for example, with a shuttle valve (not shown) to modulate the engine oil. In some examples, the valves may be actuated such that one of the first and second valves 164 and 170 is normally open and the other is normally closed. In other examples, the first and second valves 164 and 170 may be pneumatic valves, electric valves, or another suitable valve.

Note the term "valve" refers to a device that is controllable to selectively fully open, fully close, or partially open a passage to control gas flow through the passage. Moreover, the valve may be controllable to any position between open and closed to vary gas flow to a commanded gas flow. It is to be understood that valve is merely one example of a control device and any suitable control element may be employed to control gas flow without departing from the scope of this disclosure.

As shown in FIG. 1, the vehicle system 100 further includes an EGR mixer 172 which mixes the recirculated exhaust gas with charge air such that the exhaust gas may be evenly distributed within the charge air and exhaust gas mixture. In the embodiment depicted in FIG. 1, the EGR system 160 is a high-pressure EGR system which routes exhaust gas from a location upstream of turbochargers 120 and 124 in the exhaust passage 116 to a location downstream of turbochargers 120 and 124 in the intake passage 114. In other embodiments, the vehicle system 100 may additionally or alternatively include a low-pressure EGR system which routes exhaust gas from downstream of the turbochargers 120 and 124 in the exhaust passage 116 to a location upstream of the turbochargers 120 and 124 in the intake passage 114.

An EGR filter 174, also referred to as a particle separator, may be positioned in the EGR passage 162, downstream of the EGR cooler 166. The EGR filter 174 may include a particle separating element, such as angled vanes and/or a filter, and a particle trap. In one example, particles or wear debris traveling in the gas flow may be separated out from the gas with the filter positioned within the gas flow passage. The gas flow passage may include the EGR passage. The EGR filter 174 may include a plurality of overlapping and angled vanes which allow gas to pass through the vanes. However, the denser wear debris particles may not pass through the vanes. As such, these particles may be trapped at a bottom of the gas flow passage. In some examples, EGR filter 174 may include a particle trap for collecting the trapped particles. The particle trap may be recessed from the gas flow passage in order to avoid flow restriction from the trapped particles. Gas that passes through the particle separator may then have fewer particles or wear debris than the gas entering the filter. In one example, the particle separating element and the particle trap may be positioned within a flow passage segment. The flow passage segment may then be positioned within a gas flow passage coupled to the engine, such as EGR passage 162. Alternatively, the particle separating element may be positioned within and integrated into the gas flow passage coupled to the engine.

In some embodiments, a check valve 176 may be positioned in the EGR passage 162 downstream of filter 174 in an exhaust gas flow direction. As used herein, exhaust gas flow direction indicates a direction of flow of exhaust gas from engine 104 to atmosphere via exhaust passage 116 and/or from engine 104 to intake manifold 115 via EGR passage 162. Check valve 176 is configured to allow flow of gas only in the exhaust gas flow direction (e.g., from filter 174 to mixer 172) but not allow flow of gas in a second, opposite direction (e.g., from intake passage 114 to filter 174 via mixer 172). Thus, check valve 176 only blocks flow of gas through the EGR filter in the second direction.

As depicted in FIG. 1, the vehicle system 100 further includes a two-stage turbocharger with the first turbocharger 120 and the second turbocharger 124 arranged in series, each of the turbochargers 120 and 124 arranged between the intake passage 114 and the exhaust passage 116. The two-stage turbocharger increases air charge of ambient air drawn into the intake passage 114 in order to provide greater charge density during combustion to increase power output and/or engine-operating efficiency. The first turbocharger 120 operates at a relatively lower pressure, and includes a first turbine 121 which drives a first compressor 122. The first turbine 121 and the first compressor 122 are mechanically coupled via a first shaft 123. The first turbocharger may be referred to the "low-pressure stage" of the turbocharger. The second turbocharger 124 operates at a relatively higher pressure, and includes a second turbine 125 which drives a second compressor 126. The second turbocharger may be referred to the "high-pressure stage" of the turbocharger. The second turbine and the second compressor are mechanically coupled via a second shaft 127.

As explained above, the terms "high pressure" and "low pressure" are relative, meaning that "high" pressure is a pressure higher than a "low" pressure. Conversely, a "low" pressure is a pressure lower than a "high" pressure.

As used herein, "two-stage turbocharger" may generally refer to a multi-stage turbocharger configuration that includes two or more turbochargers. For example, a two-stage turbocharger may include a high-pressure turbocharger and a low-pressure turbocharger arranged in series, three turbocharger arranged in series, two low pressure turbochargers feeding a high pressure turbocharger, one low pressure turbocharger feeding two high pressure turbochargers, etc. In one example, three turbochargers are used in series. In another example, only two turbochargers are used in series.

In the embodiment shown in FIG. 1, the second turbocharger 124 is provided with a turbine bypass valve 128 which allows exhaust gas to bypass the second turbocharger 124. The turbine bypass valve 128 may be opened, for example, to divert the exhaust gas flow away from the second turbine 125. In this manner, the rotating speed of the compressors 126, and thus the boost provided by the turbochargers 120, 124 to the engine 104 may be regulated during steady state conditions. Additionally, the first turbocharger 120 may also be provided with a turbine bypass valve. In other embodiments, only the first turbocharger 120 may be provided with a turbine bypass valve, or only the second turbocharger 124 may be provided with a turbine bypass valve. Additionally, the second turbocharger may be provided with a compressor bypass valve 129, which allows gas to bypass the second compressor 126 to avoid compressor surge, for example. In some embodiments, first turbocharger 120 may also be provided with a compressor bypass valve, while in other embodiments, only first turbocharger 120 may be provided with a compressor bypass valve.

As explained above, during engine operation, one or more EGR valves (e.g., valves 163, 164, and/or 170) may be adjusted to flow a designated amount of exhaust gas from the donor cylinders to the engine intake. However, during some conditions the flow of gas through the EGR system may reverse, and exhaust and/or intake air may flow back to the cylinders via donor manifold 119. Such EGR backflow may carry debris and/or may dislodge debris or other wear particles from EGR filter 174. The debris may be deposited in the engine, causing engine damage if the material is large enough or is recirculated in significant quantities.

To prevent the backflow of air containing debris to the engine, one or more of the EGR valves may be closed responsive to an indication that EGR flow has reversed or is about to reverse. For example, when the pressure of the exhaust gas in EGR passage 162 is less than the pressure of intake air in intake manifold 115, the EGR flow may reverse and flow back to the engine 104. Such conditions may occur during a rapid shutdown of the engine, where combustion is disabled but intake pressure is greater than the exhaust pressure. For example, when combustion is disabled, exhaust pressure decreases yet intake pressure may remain high due to continued spinning of the turbocharger. Such rapid shutdowns may be performed by a vehicle operator in response to an emergency or failure condition, and may be differentiated from standard engine shutdowns in that fuel injection is abruptly cut off during a rapid engine shutdown, causing a rapid loss of engine speed, rather than a gradual reduction in engine speed that may occur during a standard engine shutdown.

By closing one or more of the EGR valves responsive to a change in pressure differential resulting in backflow of the exhaust gas (e.g., during a rapid engine shutdown), the reversed exhaust flow will be blocked from reaching the engine, and any particles in the filter will remain in the filter rather than being dislodged. Further, in some embodiments where check valve 176 is present in EGR passage 162, the backflow of exhaust will be blocked from reaching the filter 174 by the check valve 176.

In one example, EGR metering valve 170 may be closed responsive to a predicted or occurring change in exhaust flow direction. For example, EGR metering valve 170 may be closed during a rapid engine shutdown, following stoppage of fuel injection. EGR metering valve 170 (as well as other air-handling valves of vehicle system 100, including EGR valves 163 and 164 and turbocharger bypass valves 128 and 129) may be a hydraulic spool valve that is actuated via oil pressure supplied from the main engine oil gallery. In order for the EGR metering valve to be closed during the rapid engine shutdown, and held closed while the exhaust flow reverses direction, the supply of oil provided to the actuator of the valve may be greater than the air pressure acting on the valve. Immediately following the engine shutdown, the oil pressure in oil gallery remains pressurized. Thus, the EGR metering valve actuator is provided with pressurized engine oil upon indication that the rapid shutdown has occurred in order to close the valve.

Thus, the system of FIG. 1 provides for a system comprising an exhaust gas recirculation (EGR) system configured to selectively route exhaust gas in an EGR flow direction from at least a subset of cylinders of an engine to an intake of the engine via an EGR passage; a filter positioned in the EGR passage and configured to filter the exhaust gas passing through the EGR passage in the EGR flow direction; and at least one of an EGR bypass valve or an EGR metering valve upstream of the filter, the at least one of the EGR bypass valve or EGR metering valve configured to prevent backflow of the exhaust gas to at least the subset of cylinders. (Upstream refers to the valve(s) being situated, with respect to a location of the filter, opposite a direction of exhaust flow extending from the subset of cylinders to the valve(s), then to the filter, and then to the intake.) The system further includes a control unit configured to flow exhaust gas in the EGR flow direction through the EGR system, and block a flow of gas through the EGR system in a second direction opposite the EGR flow direction.

In some examples, the control unit is configured to close one or more of the EGR metering valve or the EGR bypass valve to block the flow of gas through the EGR system in the second direction opposite the EGR flow direction. The control unit may also be configured to detect an engine shutdown and close the one or more of the EGR metering valve or the EGR bypass valve responsive to the engine shutdown.

The system may further include a one-way mechanical valve positioned in the EGR passage downstream of the filter in the EGR flow direction. The one-way mechanical valve is configured to block the flow of gas through the EGR system in the second direction.

At least one of the EGR metering valve or the EGR bypass valve may comprise a spool valve. The spool valve may be a hydraulic spool valve that controls the position of the EGR metering and/or EGR bypass valve. The EGR metering and/or bypass valve is configured to close when provided oil pressure of adequate magnitude to overcome the gas forces acting in the EGR system. The EGR metering valve may be positioned in the EGR passage upstream of the filter in the EGR flow direction. In other examples, the EGR metering valve and/or EGR bypass valve may comprise a solenoid, a pneumatic actuator, or an electric motor actuator.

Figure 2:
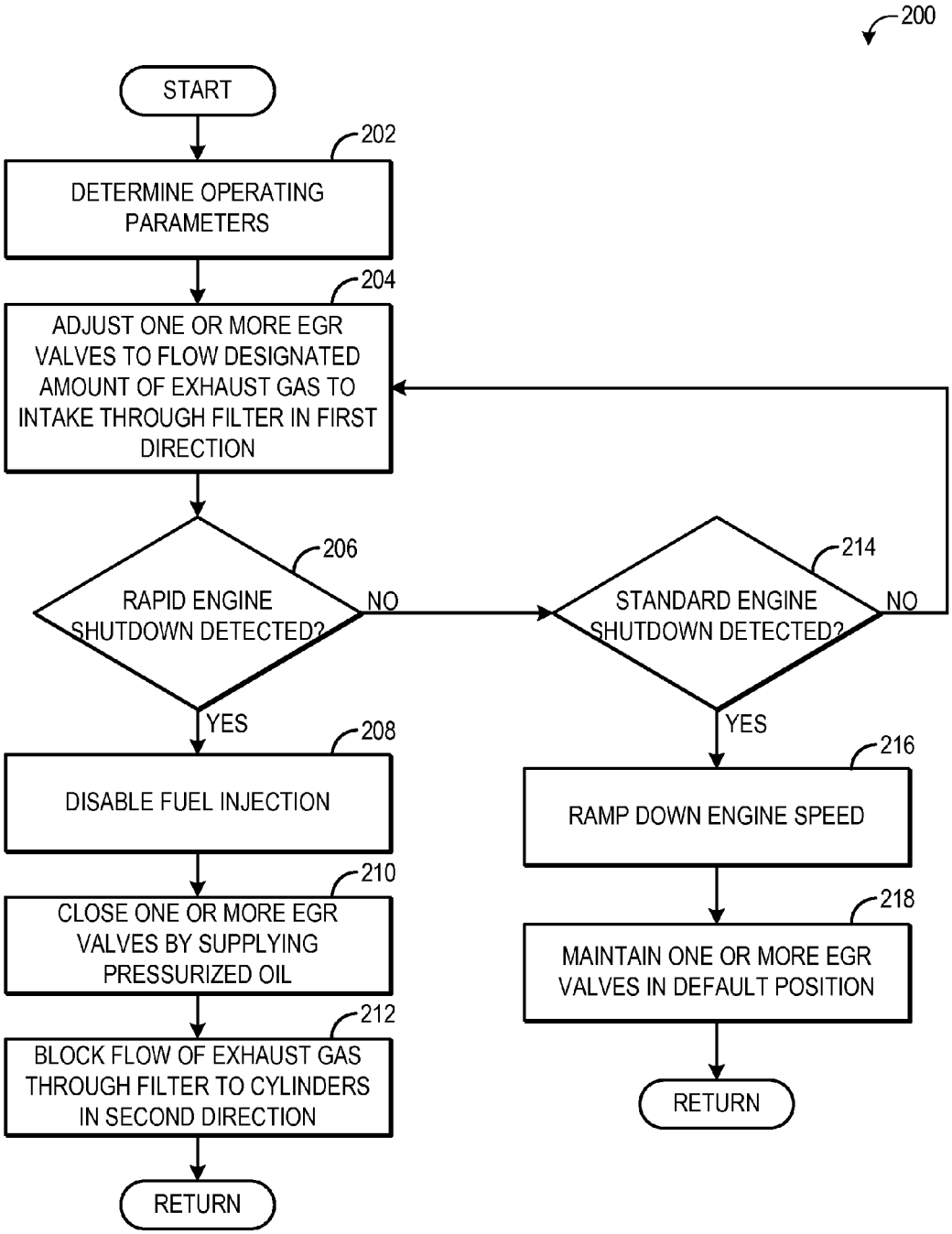
FIG. 2 shows a flow chart illustrating a method for preventing exhaust backflow according to an embodiment of the invention.

FIG. 2 is a flow chart illustrating a method 200 for preventing backflow of exhaust gas through an EGR system. Method 200 may be carried out by an engine controller, such as control unit 180, according to instructions stored thereon. At 202, method 200 includes determining operating parameters. The determined operating parameters may include, but are not limited to, engine speed and load, EGR valve position, engine operating status, and other operating parameters. At 204, one or more EGR valves are adjusted to flow a designated amount of exhaust gas to an engine intake through an EGR filter in a first direction. For example, one or more of EGR metering valve 170, EGR bypass valve 164, and EGR valve 163 may be adjusted so that the intake air reaching the engine has a designated oxygen concentration. The designated oxygen concentration of the intake air may be based on the current engine speed and load, for example. The designated amount of exhaust gas from the engine may flow through an EGR filter positioned in an EGR passage (e.g., EGR filter 174) prior to reaching the engine intake. This EGR flow occurs in a first, EGR flow direction, from the engine exhaust through the filter and to the intake. In one example, the exhaust routed back to the engine may be routed exclusively from a subset of the cylinders (e.g., a first cylinder group, also referred to as the donor cylinders). Exhaust from the remaining cylinders (e.g., a second cylinder group, also referred to the non-donor cylinders) may be exclusively routed to atmosphere. Further, during some conditions, at least a portion of the exhaust from the first cylinder group may also be routed to atmosphere.

At 206, it is determined if a rapid engine shutdown is detected. The rapid engine shutdown may be detected based on a signal received at the controller. For example, the operator of the vehicle in which the engine is installed may activate the rapid engine shutdown during an emergency or failure state of the engine or vehicle. The emergency or failure state of the engine or vehicle may include conditions where immediate shutdown of the engine is required, including an unanticipated stop (due to a blockage of the vehicle for example), degradation to certain engine components (such as degradation of the turbocharger), or other conditions in which continued operation of the engine may be undesirable. As explained previously, rapid engine shutdown may include combustion being disabled with intake pressure being higher than exhaust pressure. If a rapid shutdown of the engine is not detected, method 200 proceeds to 214, which will be explained below.

If a rapid engine shutdown is detected, method 200 proceeds to 208 to disable fuel injection, thus shutting down the engine. The cessation of fuel injection and subsequent fast slowdown of the engine may cause the pressure of the exhaust gas in the EGR system to drop below the intake air pressure. For example, the turbocharger turbine may continue to spin for a period after engine shutdown, causing the intake air to remain compressed. However, because combustion has ceased, the exhaust pressure may drop. As a result, the intake air may instead start to flow into the EGR system, flowing through the EGR filter and to the engine in a second direction, opposite the first direction. This backflow of exhaust and intake air may deposit debris in the engine, degrading the engine. To prevent this exhaust backflow, at 210, one or more of the EGR valves is closed. The EGR valves may be closed due to the valves being provided with pressurized oil from the engine oil gallery, for example, which may remain pressurized for a duration after rapid engine shutdown due to heat rejection from the engine or other factors. At 212, the flow of exhaust gas through the filter to the cylinders of the engine in the second direction, opposite the first direction, is blocked. In some examples, the flow of exhaust in the second direction may alternatively or additionally be blocked by a mechanical one-way valve positioned in the EGR system, such as check valve 176.

Returning to 206, if it is determined that the engine is not in a rapid shutdown mode, method 200 proceeds to 214 to determine if a standard engine shutdown is detected. The standard engine shutdown may be a scheduled engine shutdown anticipated due to the vehicle reaching a final destination. The standard engine shutdown may include a ramping down of engine speed and gradual braking of the vehicle, and/or may include incremental adjustments to the throttle of the engine (e.g., incremental shifting from one notch setting to a lower notch setting). During the standard engine shutdown, fuel injection to the engine may continue. Standard engine shutdown may be detected based on a signal received at the controller from an input from the operator, or from a remote controller that indicates the vehicle trip is about to end. If a standard engine shutdown is not detected, for example if the engine is still operating, method 200 proceeds to 204 to continue to adjust the EGR valves to deliver the designated EGR amount.

If a standard engine shutdown is detected, method 200 proceeds to 216 to ramp down engine speed. Ramping down engine speed may include continuing to inject fuel to the engine (albeit at lower quantities in some examples) for a duration until engine speed reaches a low speed threshold, at which point fuel injection may be ceased. During the ramping down of the engine speed, the vehicle brakes may be applied, the throttle setting may be adjusted (e.g., lowered), and other operating parameters may be adjusted. Further, standard engine shutdown may include, at least for a duration, exhaust pressure being equal to or greater than intake pressure. At 218, the one or more EGR valves may be maintained or moved into a default position. The default position may be the position the valves are moved into based on the drop in oil pressure and changes in exhaust pressure acting on the EGR valves as the engine speed decreases. In one example, the default position may be at least partially open. With loss of the ECU control signal at shutdown and adequate oil pressure available, the valve will move to a designed position that may be normally open or normally closed as required by the system. The default configuration of the EGR valves during a standard shutdown is chosen to create an exhaust flow condition that does not result in a flow of exhaust gas through the filter to the cylinders of the engine in the second direction, opposite the first direction during standard engine shutdown. In a rapid shutdown, as the exhaust and intake pressure are not as they would be if there was fuel injection, the default configuration of the EGR valves may result in flow of exhaust gas through the filter to the cylinders of the engine in the second direction.

Figure 3:
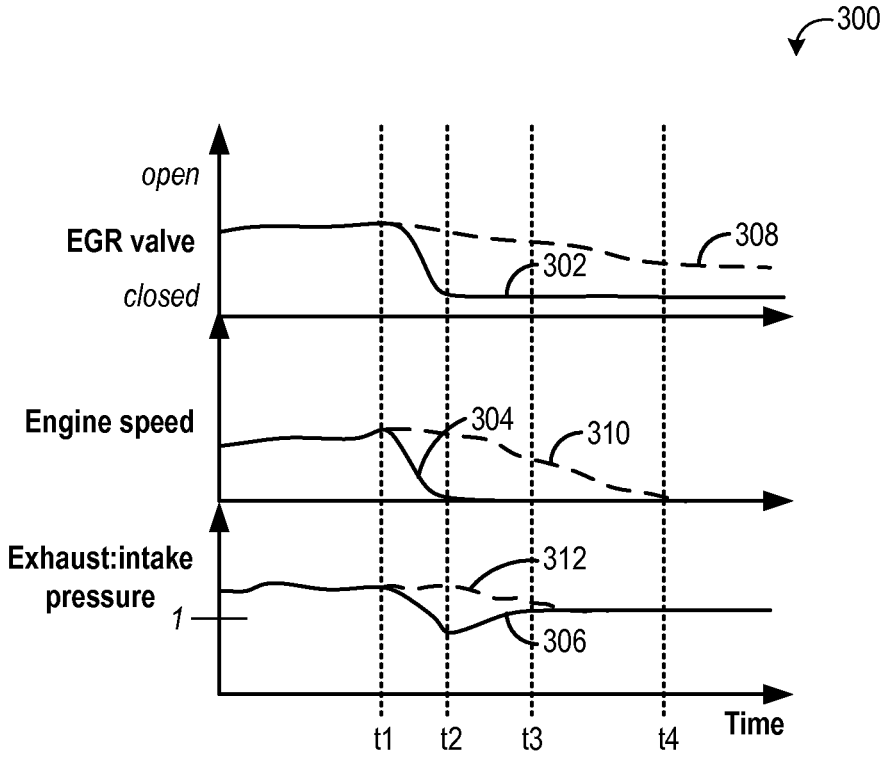
FIG. 3 shows a diagram illustrating example parameters of interest during the execution of the method illustrated in FIG. 2.

FIG. 3 is a diagram 300 illustrating operating parameters of an engine installed in a vehicle during both a rapid engine shutdown and a standard engine shutdown according to an embodiment of the invention. For example, the engine may be engine 104 installed in rail vehicle 106. Diagram 300 illustrates the position of an EGR valve (such as EGR metering valve 170), engine speed, and a ratio of exhaust to intake pressure. For each operating parameter, time is illustrated on the horizontal axis and values of each respective operating parameter are illustrated on the vertical axis. Operating parameters observed during a rapid engine shutdown are illustrated by the solid curves, while operating parameters observed during a standard engine shutdown are illustrated by the dashed curves. However, before the engine is shutdown is initiated (prior to time t1 in diagram 300), the operating parameters for both the rapid engine shutdown and standard engine shutdown are the same, and thus are illustrated by a single solid curve.

Prior to time t1, EGR is flowing through the EGR system to the engine intake. To flow the EGR, the EGR valve is partially open, as shown by curve 302. The engine is operating at moderate speed, as shown by curve 304. The exhaust pressure in the EGR system is greater than the intake pressure, as shown by curve 306, thus enabling the EGR to flow from the EGR passage to the intake passage. At time t1, a rapid engine shutdown may be initiated by a vehicle operator, in response to an emergency or failure condition (e.g., a stalled vehicle on the tracks ahead of where the rail vehicle is travelling). To quickly bring the vehicle to a stop, fuel injection is stopped, causing a rapid drop in engine speed, as shown by solid curve 304. This change in engine speed results in a drop in the exhaust:intake pressure, as shown by solid curve 306. To prevent backflow of exhaust and/or intake air through the EGR system, the EGR valve is moved into the fully closed position responsive to the indication that the engine is being shutdown, as shown by solid curve 302. At time t2, the engine has stopped spinning (e.g., engine speed is zero), the EGR valve is fully closed, and the exhaust:intake pressure ratio begins to increase. By time t3, the exhaust:intake pressure ratio reaches one and remains constant.

In contrast, at time t1 a standard engine shutdown may be initiated. During the standard engine shutdown, the engine speed decreases much more gradually than during the rapid engine shutdown, as shown by dashed curve 310. For example, during the rapid engine shutdown, the engine stops spinning by time t2; during the standard engine shutdown, the engine does not stop spinning until time t4. Due to the slow engine shutdown, the exhaust:intake pressure ratio does not rapidly decrease, and remains at or above one, as shown by dashed curve 312. Because a pressure reversal does not occur during the standard engine shutdown, exhaust continues to flow either to atmosphere (via the exhaust passage) or to the engine intake (via the EGR passage), and does not backflow to the engine. Thus, the EGR valve may remain in a default position. In the illustrated example, the EGR valve remains partially open during the engine shutdown, as shown by dashed curve 308.

In an embodiment, a method comprises flowing exhaust gas through an exhaust gas recirculation (EGR) passage in a first direction from at least a first cylinder group of an engine to an intake manifold of the engine, the exhaust gas flowing in the first direction through a filter arranged in the EGR passage prior to reaching the intake manifold, and blocking flow of gas through the filter in a second, opposite direction with a mechanical one-way valve positioned in the EGR passage between the filter and the intake manifold.

Blocking the flow of gas through the filter in the second direction may comprise blocking flow of exhaust gas and flow of intake air through the filter in the second direction, the intake air drawn in through an intake passage.

The exhaust gas may flow in the second direction following a rapid engine shutdown. Responsive to the rapid engine shutdown, the method may further comprise closing an EGR metering valve positioned in an EGR passage downstream of the filter. Flowing exhaust gas in the first direction further may comprise flowing exhaust gas through the EGR metering valve prior to the exhaust gas reaching the intake manifold, the EGR metering valve adjusted to flow a designated amount of exhaust gas. In some examples, the EGR metering valve is a hydraulic spool valve. In some examples, the EGR metering valve is modulated by a hydraulic spool valve.

In another example, blocking the flow of gas through the filter in the second direction comprises blocking the flow of gas via a check valve positioned in an EGR passage upstream of the filter.

The method may further comprise flowing exhaust gas from a second cylinder group of the engine to atmosphere. During conditions where the EGR metering valve is at least partially open, the method may include delivering intake air and exhaust gas to both the first cylinder group and the second cylinder group.

In another embodiment, a system comprises an exhaust gas recirculation (EGR) system configured to route exhaust gas through an EGR passage in a first direction from at least a first cylinder group of an engine to an intake manifold of the engine. The system further comprises a filter positioned in the EGR passage between the at least the first cylinder group and the intake manifold. The filter is configured to filter the exhaust gas routed through the EGR passage in the first direction and prior to the exhaust gas reaching the intake manifold. The system further comprises a mechanical one-way valve positioned in the EGR passage between the filter and the intake manifold. The mechanical one-way valve is configured to block flow of gas through the filter in a second, opposite direction.

Another embodiment of a method comprises, during engine operating conditions, adjusting one or more of an EGR metering valve and an EGR bypass valve to flow a designated amount of exhaust gas from at least a first cylinder group of an engine to an intake manifold, and responsive to a rapid engine shutdown, closing the EGR metering valve to prevent backflow of the exhaust gas to the first cylinder group.

During engine operating conditions and when the EGR metering valve is at least partially open, the method includes flowing exhaust gas from the first cylinder group to the intake manifold via a filter. During engine operating conditions and when the EGR bypass valve is at least partially open, the method includes flowing exhaust gas from the first cylinder group to atmosphere.

The method may further comprise blocking flow of exhaust gas through the filter, in a direction opposite that of the exhaust gas flowing from the first cylinder group through the filter and to the intake manifold, with a mechanical one-way valve positioned between the filter and the intake manifold.

In an example, closing the EGR metering valve comprises directing oil from an oil gallery to the EGR metering valve, the oil from the oil gallery having adequate pressure in the control valve in relationship to the forces imparted on the valve due to the backflow of exhaust gas following the rapid engine shutdown. Responsive to a non-rapid engine shutdown, the method includes maintaining the EGR metering valve in a default position.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A method, comprising:

flowing exhaust gas through an exhaust gas recirculation (EGR) passage in a first direction from a first cylinder group of an engine to an intake manifold of the engine, the exhaust gas flowing in the first direction through a filter arranged in the EGR passage prior to reaching the intake manifold, the exhaust gas flowing through an EGR metering valve prior to the exhaust gas reaching the filter, the EGR metering valve adjusted to flow a designated amount of exhaust gas;

flowing exhaust gas from a second cylinder group of the engine to atmosphere;

when the EGR metering valve is at least partially open, delivering intake air and exhaust gas to both the first cylinder group and the second cylinder group; and blocking flow of gas through the filter in a second, opposite direction with a mechanical one-way valve positioned in the EGR passage between the filter and the intake manifold.

2. The method of claim 1, wherein blocking the flow of gas through the filter in the second direction comprises blocking flow of exhaust gas and flow of intake air through the filter in the second direction, the intake air drawn in through an intake passage.

3. The method of claim 1, wherein the exhaust gas flows in the second direction following a rapid engine shutdown.

4. A method, comprising:

during engine operating conditions, adjusting one or more of an exhaust gas recirculation (EGR) metering valve and an EGR bypass valve to flow a designated amount of exhaust gas from a first cylinder group of an engine to an intake manifold;

responsive to a rapid engine shutdown, closing the EGR metering valve to prevent backflow of the exhaust gas to the first cylinder group; and responsive to a non-rapid engine shutdown, maintaining the EGR metering valve in a default position.

5. The method of claim 4, further comprising, during engine operating conditions and when the EGR metering valve is at least partially open, flowing exhaust gas from the first cylinder group through a filter and to the intake manifold.

6. The method of claim 5, further comprising blocking flow of exhaust gas through the filter, in a direction opposite that of the exhaust gas flowing from the first cylinder group through the filter and to the intake manifold, with a mechanical one-way valve positioned between the filter and the intake manifold.

7. The method of claim 4, wherein closing the EGR metering valve comprises directing oil from an oil gallery to the EGR metering valve, the oil from the oil gallery having adequate pressure to control the EGR metering valve in relationship to forces imparted on the EGR metering valve by the backflow of exhaust gas following the rapid engine shutdown.

8. The method of claim 4, wherein the rapid engine shutdown comprises engine speed reduction faster than a more gradual reduction in engine speed during the non-rapid engine shutdown.

9. The method of claim 4, further comprising:

during engine operating conditions and when the EGR bypass valve is at least partially open, flowing exhaust gas from the first cylinder group to atmosphere; and flowing exhaust gas from a second cylinder group of the engine to atmosphere.

10. The method of claim 9, further comprising, when the EGR metering valve is at least partially open, delivering intake air and exhaust gas to both the first cylinder group and the second cylinder group.

11. The method of claim 4, wherein the default position is based on oil pressure and exhaust pressure as engine speed decreases during the non-rapid engine shutdown.

12. The method of claim 4, wherein the default position comprises the EGR metering valve being at least partially open.

13. The method of claim 4, wherein the rapid engine shutdown is performed responsive to a command from an operator of a vehicle in which the engine is installed, and wherein the non-rapid engine shutdown comprises a scheduled shutdown of the engine.

14. A system, comprising:

an exhaust gas recirculation (EGR) system configured to selectively route exhaust gas in an EGR flow direction from at least a subset of cylinders of an engine to an intake of the engine via an EGR passage;

a filter positioned in the EGR passage and configured to filter the exhaust gas passing through the EGR passage in the EGR flow direction; and at least one of an EGR bypass valve or an EGR metering valve upstream of the filter, the at least one of the EGR bypass valve or EGR metering valve configured to prevent backflow of the exhaust gas to at least the subset of cylinders by closing in response to backflow conditions, including directing oil from a main engine oil gallery to the at least one of the EGR bypass valve or EGR metering valve, the oil having adequate pressure to control the at least one of the EGR bypass valve or EGR metering valve in relationship to forces imparted on the at least one of the EGR bypass valve or EGR metering valve by the backflow of exhaust gas during the backflow conditions.

15. The system of claim 14, further comprising a control unit configured to close one or more of the EGR metering valve or the EGR bypass valve to block a flow of gas through the EGR system in a second direction opposite the EGR flow direction.

16. The system of claim 15, wherein the control unit is configured to determine an engine shutdown, and to close the one or more of the EGR metering valve or the EGR bypass valve responsive to the engine shutdown.

17. The system of claim 14, further comprising a one-way mechanical valve positioned in the EGR passage downstream of the filter in the EGR flow direction, the one-way mechanical valve configured to block the flow of gas through the EGR system in a second direction opposite the EGR flow direction.

18. The system of claim 14, wherein at least one of the EGR metering valve or the EGR bypass valve comprises a hydraulic spool valve, and wherein the EGR metering valve and the EGR bypass valve are configured to close when provided with oil having a greater pressure than a pressure of gas flowing in the EGR system.

19. A system, comprising:

an engine having a first cylinder group and a second cylinder group, the second cylinder group configured to flow exhaust gas to atmosphere;

an exhaust gas recirculation (EGR) system configured to route exhaust gas through an EGR passage in a first direction from the first cylinder group of the engine to an intake manifold of the engine coupled to both the first cylinder group and the second cylinder group;

a filter positioned in the EGR passage between the at least the first cylinder group and the intake manifold, wherein the filter is configured to filter the exhaust gas routed through the EGR passage in the first direction and prior to the exhaust gas reaching the intake manifold, the exhaust gas flowing through an EGR metering valve prior to the exhaust gas reaching the filter, the EGR metering valve adjustable to flow a designated amount of exhaust gas; and a mechanical one-way valve positioned in the EGR passage between the filter and the intake manifold, the valve configured to block flow of gas through the filter in a second, opposite direction.

* * * * *